United States Patent [19]

Ruscoe et al.

[11] Patent Number: 4,579,761

[45] Date of Patent: Apr. 1, 1986

[54] METHOD OF MAKING AUREATE COLORED COINS, MEDALLIONS AND TOKENS AND PRODUCTS SO MADE

[75] Inventors: Michael J. H. Ruscoe, St. Albert; Willie Seibt, Edmonton, both of Canada

[73] Assignee: Sherritt Gordon Mines Ltd., Toronto, Canada

[21] Appl. No.: 761,333

[22] Filed: Jul. 31, 1985

Related U.S. Application Data

[63] Continuation of Ser. No. 612,763, May 22, 1984, abandoned.

[30] Foreign Application Priority Data

May 1, 1984 [CA] Canada ..... 453305

[51] Int. Cl.[4] ..... B32B 15/02; C25D 3/58; C25D 5/50; G09F 3/02

[52] U.S. Cl. ..... 428/542.8; 40/27.5; 72/47; 204/23; 204/37.3; 204/44; 428/64; 428/658; 428/579; 428/674; 428/675

[58] Field of Search ..... 72/47; 40/27.5; 428/579, 674, 675, , 658, 64, 542.8; 204/23, 44, 37.3

[56] References Cited

U.S. PATENT DOCUMENTS

| | | | |
|---|---|---|---|
| 3,108,006 | 10/1963 | Knedi et al. | 204/44 X |
| 3,834,879 | 9/1974 | Chin | 40/27.5 X |
| 4,089,753 | 5/1978 | McMullen et al. | 204/23 |
| 4,176,014 | 11/1979 | Ruscoe et al. | 204/23 |
| 4,247,374 | 1/1981 | Ruscoe et al. | 204/23 |
| 4,401,488 | 8/1983 | Prinz et al. | 148/435 |
| 4,436,790 | 3/1984 | Prinz et al. | 428/675 |

FOREIGN PATENT DOCUMENTS

| | | | |
|---|---|---|---|
| 191288 | 8/1937 | Switzerland | 40/27.5 |
| 1210180 | 10/1970 | United Kingdom | 428/671 |
| 1276272 | 6/1972 | United Kingdom | 40/27.5 |
| 2102708 | 2/1983 | United Kingdom | 204/23 |

OTHER PUBLICATIONS

Abner Brenner, "Electrodeposition of Alloys", vol. I, pp. 497–543, (1963).

*Primary Examiner*—G. L. Kaplan
*Attorney, Agent, or Firm*—Stevens, Davis, Miller & Mosher

[57] ABSTRACT

An aureate coin, coin blank, medallion, medallion blank, token or token blank has a coin-shaped core with opposed faces and a peripheral side edge and of mintable metallic material. An electroplated coating of copper and tin completely encases the core and provides a golden appearance. The electroplated coating contains from about 8 to about 16% tin by weight and has a thickness of from about 10 to about 150 μm.

15 Claims, No Drawings

METHOD OF MAKING AUREATE COLORED COINS, MEDALLIONS AND TOKENS AND PRODUCTS SO MADE

This application is a continuation of application Ser. No. 612,763, filed May 22, 1984, and now abandoned.

This invention relates to aureate coins, medallions or tokens and blanks used for the production of coins, medallions or tokens, that is to say metal blanks or minted coins, medallions or tokens having a golden appearance.

Many countries are replacing or planning to replace bank notes by coins, mainly because bank notes are expensive forms of currency compared to coins in view of the relatively short life or bank notes. Bank notes are thus not desirable as low value currency, and inflation is of course resulting in bank notes in many countries now representing low value currency. It is bank notes of such low value currency that are being replaced by coins.

It has become established in many countries that low value coins have a copper colour, and that middle and high value coins have a silver colour. In the past, solid gold coins have been used for relatively high value currency, but today are struck only for the numismatic value or as a convenient form of bullion. However, gold is now so expensive that a present day gold coin would necessarily comprise a base metal core with a very thin gold coating, perhaps only 1–2 μm. The small gold thickness would be likely to wear through to the base metal core during the normal service life of the coin and the intrinsic value of the gold would be lost.

Various attempts have been made to produce satisfactory inexpensive aureate coins for use as relatively high value currency. Brass, typically 70% copper and 30% zinc, is a common yellow coinage alloy, but it tarnishes in service and is thus associated with cheapness in the public eye. An attempt has recently been made to overcome this problem by replacing 5% of the zinc with nickel, but the resulting colour is a pale yellow rather than gold. In another attempt, an alloy composition of 92% copper, 6% nickel and 2% aluminum has been used, but this composition has a pink hue and tends to turn brown in service. Other attempts have also been made with other alloy compositions but none has had a long lasting satisfactory golden appearance.

Another problem with common yellow coins of solid low melting point brass and bronze is that they are easy to counterfeit. Still another problem is that a coin must have acceptable physical properties, such as weight, size and electrical and magnetic properties, for use in coin-operated vending equipment having coin testing devices which rely on such properties to distinguish a required coin from other coins and fraudulent replicas of the required coin. For example, the nickel-modified brass coin mentioned above is non-magnetic and hence will not be accepted by vending equipment which only accepts magnetic coins. A further problem is that a coin blank must be readily mintable, i.e. it must be soft enough to be readily deformed by coin dies during the minting procedure to impart the required insignia to the coin faces. The coin blanks must not be too hard, otherwise the costly coin dies would wear out too quickly or an undesirable shallow impression would be produced on the struck coin. This is undesirable since coin dies are expensive.

It is therefore an object of the invention to provide an aureate coin which overcomes the above mentioned problems, that is to say an aureate coin which is relatively inexpensive to produce, has a satisfactory service life with respect both to acceptable colour and other physical properties such as wear, is suitable for use in coin-operated vending equipment with coin validation devices which check physical properties including electrical and magnetic properties, and is not easily counterfeited.

According to the invention, a coin, medallion or token product (i.e. a minted coin, medallion or token or blanks used for the production of coins, medallions or tokens) has a coin-shaped core with opposed faces and a peripheral side edge of mintable metallic material, and an electroplated coating comprising copper and tin completely encasing the core and providing a long lasting golden appearance in use. The electroplated coating may contain from about 8 to about 16% tin by weight, preferably from about 11 to about 14%. The electroplated coating may have a thickness on each core face of from about 10 to about 150 μm, preferably from about 30 to about 50 μm. The total weight of the electroplated coating may be from about 2 to about 26%, preferably from about 6 to about 10%, of the total weight of the product.

Although it is known to electroplate metal articles such as door handles with an alloy of copper and tin to produce a bronze finish, bronze of the composition described, particularly at the high end of the tin range, is well known to be a hard alloy which cannot be readily rolled or worked into strip form, i.e. which cannot normally be worked into a coinage product. Thus, bronzes in the above composition range would not normally be considered for use as coinage materials. Also, considering the relatively high cost of tin, such high tin alloys would not normally be considered for coinage.

In accordance with the present invention however, it has been discovered that a coin, medallion or token product as described above has an acceptable long-lasting aureate appearance, i.e. is satisfactorily resistant to tarnishing, and with suitable choice of core material is readily mintable and has suitable properties for acceptance by conventional coin selection devices in vending machines. A coin, medallion or token product in accordance with the invention is also inexpensive to produce and has a satisfactory service life. Also, compared to coins with a homogeneous composition, a coin, medallion or token product in accordance with the invention is not readily counterfeitable.

Coin, medallion or token blanks in accordance with the invention may for example be produced in barrel-plating equipment in the manner described in Canadian Pat. No. 1,093,498, issued Jan. 13, 1981 and the corresponding U.S. Pat. No. 4,089,753 issued May 16, 1978, using a suitable copper-tin electroplating bath.

As mentioned above, the metallic core material should be readily mintable, chosen for low cost, provide specific properties for coin selection devices, and for optimum protection against counterfeiting. The core material may for example comprise, iron, steel or stainless steel, nickel, nickel-plated steel, zinc, copper or various alloys of copper containing zinc and/or nickel and/or tin. It is also recognized that if given a suitable pretreatment, cores of aluminum or aluminum alloys may be used.

In some cases, the core is advantageously annealed, before or after plating, to give the blank a satisfactory low hardness for minting. Annealing after electroplating is also advantageous in that it can be used to create a metallurgical bond by interdiffusion between the electroplated copper-tin coating and the core material. If the core material is already soft enough for minting, as with zinc, annealing may be omitted.

A further advantage is that coins, medallions or tokens in accordance with the invention have a relatively low friction surface which renders them relatively easy to extract from coin minting collars after striking.

Tests have shown that aureate coins in accordance with the invention and having a nickel core may have similar physical properties (including magnetic properties) to nickel or nickel-plated steel coins for which coin vending devices have been designed, and hence may replace such prior coins without any changes being necessary to the coin vending devices. Furthermore, aureate coins having specially selected core materials consisting principally of alloys of copper, zinc and nickel have been shown to have a discrete and unique response in modern electro-magnetic coin vending devices, thus providing high security against counterfeiting.

Production of aureate coins in accordance with the invention and having nickel cores will now be described by way of example.

EXAMPLE

A batch comprising 25 kg of rimmed solid nickel blanks was loaded into a perforated, rotatable, horizontal plating barrel of length 91 cm and diameter 36 cm. The barrel was then passed through a cleaning cycle consisting of rinses in hot alkaline detergent, hot water, cold water, 10% HCl and again in cold water.

After the final rinse, the barrel was immersed in an alkaline copper-tin plating bath containing about 32 g/L copper and 26 g/L tin. The temperature of the bath was 75° C., and a voltage of 6.25 V was applied giving a current of 431 A. After 3.6 h, the barrel was removed from the plating bath and passed through a cold rinse and an antistain rinse.

After plating, the blanks were found to have a copper-tin electrodeposit equal to 9.1% of the weight of the plated blank. The tin content of the deposit was 13.0%. The thickness of the electrodeposit was 43 μm on the faces and 105 μm on the side edge.

The plated blanks were then passed to a production annealing furnace with a temperature setting of 750° C. and a hot zone retention time of 12 minutes to reduce their hardness from about 78 to about 32 on the Rockwell 30T hardness scale. Annealed blanks were then cleaned, polished and brightened in a two-stage process comprising acid washing followed by detergent burnishing. Burnished blanks were then minted using chromium plated dies, and produced bright, shiny, golden yellow coloured coins.

Although the major portion of the foregoing description has been concerned with coins, it will be noted that the invention is equally applicable to medallions or tokens. Other embodiments of the invention will be readily apparent to a person skilled in the art, the scope of the invention being defined in the appended claims.

What we claim as new and desire to protect by Letters Patent of the United States is:

1. A process for producing an aureate coin having mint deformed insignia on at least one face, comprising:

providing a coin core blank of the desired size and shape having opposed faces and a peripheral side edge of a first metallic material which is soft enough to be readily deformed by coin dies during minting;

electroplating said coin core blank with a coating of a second metallic material, which is harder than said first metallic material and not readily deformed by coin dies, to completely encase said coin core blank with a coating having a face thickness from about 10 to about 150 μm, said second metallic material comprising about 8 to about 16% tin by weight, with the balance copper; and forming insignia on said at least one face of the plated blank by at least one coin die deforming the surface thereof.

2. The process of claim 1, including the step of softening the coin blank by annealing prior to plating.

3. The process of claim 1, including the step of softening the coin blank by annealing after plating and prior to forming the insignia thereon.

4. An electroplated coin produced by the process of claim 1.

5. An electroplated aureate coin having insignia on at least one face formed by minting, comprising:

a coin core blank having opposed faces and a peripheral side edge of a first metallic material which is soft enough to be deformed by coin dies during minting; and an electroplated coating of a second metallic material completely encasing said blank, said coating being of a material which, by itself, is not soft enough to be deformed by coin dies and contains from about 8 to about 16% tin by weight, with the balance copper, and having a face thickness of from about 10 to about 150 μm, said insignia being formed by minting after the coating is electroplated.

6. The coin of claim 5, in which the electroplated coating contains from about 11 to about 14% tin by weight, and the balance copper.

7. The coin of claim 5, in which the face thickness of the electroplated coating is from about 30 to about 50 μm.

8. The coin of claim 5, in which the weight of the electroplated coating is from about 2 to about 26% of the weight of the coin.

9. The coin of claim 8, in which the weight of the electroplated coating is from about 6 to about 10% of the weight of the coin.

10. The coin of claim 5, in which the first metallic material comprises iron, steel or stainless steel.

11. The coin of claim 5, in which the first metallic material comprises nickel or nickel alloy.

12. The coin of claim 5, in which the first metallic material comprises zinc or zinc alloy.

13. The coin of claim 5, in which the first metallic material comprises a copper or copper alloy composition.

14. The coin of claim 5, in which the first metallic material comprises aluminum or aluminum alloy.

15. The coin of claim 5, in which the first and second metallic materials are metallurgically bonded by interdiffusion.

* * * * *